United States Patent [19]

Tiefenbach, Jr.

[11] Patent Number: 4,918,874

[45] Date of Patent: Apr. 24, 1990

[54] METHOD OF PREPARING ABRASIVE ARTICLES

[75] Inventor: Lawrence W. Tiefenbach, Jr., Traverse City, Mich.

[73] Assignee: The Dow Chemical Company, Midland, Mich.

[21] Appl. No.: 229,181

[22] Filed: Aug. 5, 1988

[51] Int. Cl.[5] ..... B24D 3/00

[52] U.S. Cl. ..... 51/293; 51/298; 51/303; 51/305; 51/308; 51/309

[58] Field of Search ..... 51/293, 298, 303, 305, 51/308, 309

[56] References Cited

U.S. PATENT DOCUMENTS

| | | | |
|---|---|---|---|
| 53,032 | 3/1966 | Nelson | 51/308 |
| 1,546,115 | 7/1925 | Beecher et al. | 51/309 |
| 2,138,829 | 12/1938 | Benner et al. | 51/280 |
| 2,734,813 | 2/1956 | Zalud | 51/298 |
| 2,768,087 | 10/1956 | Bird | 106/14 |
| 2,877,105 | 3/1959 | Smith | 51/308 |
| 2,942,991 | 6/1960 | Smith | 106/44 |
| 3,898,090 | 8/1975 | Clark | 106/38.2 |
| 3,950,149 | 4/1976 | Fukuda | 51/293 |
| 4,041,199 | 8/1977 | Cartwright | 428/36 |
| 4,128,431 | 12/1978 | Svec | 106/38.35 |
| 4,139,393 | 2/1979 | Chandhok | 106/38.3 |
| 4,517,037 | 5/1985 | Francis et al. | 156/89 |
| 4,534,773 | 8/1985 | Phaal et al. | 51/293 |
| 4,543,107 | 9/1985 | Rue | 51/309 |
| 4,591,385 | 5/1986 | Pearsall | 106/38.3 |
| 4,736,548 | 4/1988 | Atkinson et al. | 51/293 |

FOREIGN PATENT DOCUMENTS

| | | |
|---|---|---|
| 50086420 | 12/1973 | Japan . |
| 52137790 | 5/1976 | Japan . |
| 53130224 | 4/1977 | Japan . |
| 53149203 | 5/1977 | Japan . |
| 57054077 | 9/1980 | Japan . |
| 57071859 | 10/1980 | Japan . |
| 61106887A | 10/1984 | Japan . |
| 61206596A | 3/1985 | Japan . |
| 62063065A | 9/1985 | Japan . |

OTHER PUBLICATIONS

Derwent Abstract 86-155031/24.
Derwent Abstract 83-770017/38.
Derwent Abstract 334700.
Derwent Abstract 59170X/31.
Derwent Abstract 83-770016/38.

*Primary Examiner*—Theodore Morris
*Assistant Examiner*—Willie Thompson

[57] ABSTRACT

A method of preparing abrasive articles exhibiting improved homogeneity and breakdown properties is disclosed. The method comprises admixing abrasive grits and a bond phase comprising silica particles, alumina, a flux and water, to form a slurry, such that the silica particles are on the average smaller than the average grit particles; drying the slurry to form a precursor powder; and compacting the precursor powder to form an abrasive greenware article. This abrasive greenware article can then be densified, for example, by sintering, to form a densified abrasive article. The resulting abrasive article has a porcelain bond composition. Because of the uniform bond composition attained with this invention, extremely fine abrasive grits can be employed.

21 Claims, No Drawings

METHOD OF PREPARING ABRASIVE ARTICLES

FIELD OF THE INVENTION

The present invention relates to the field of abrasive articles.

BACKGROUND OF THE INVENTION

Superfine bonded abrasive articles are typically used in microfinishing machines to provide a final polish to metal or ceramic articles. This microfinishing is generally accomplished by removing surface irregularities via a cutting action, which removes the roughness while maintaining form. Surfaces that have been microfinished with bonded abrasives are flatter, more parallel, have a higher load-carrying capacity, and may also be more true-running. Commonly used for this purpose are various vitrified bonded abrasive articles. However, there are several problems encountered in manufacturing fine grit bonded abrasives to form these articles.

One problem is that it is difficult to maintain homogeneous properties throughout the matrix of the bonded article. It has been observed that the abrasive "stone" hardness will often vary from point to point. A microstructural examination of these stones reveals that in some cases the variation in hardness is due to the presence of "bond spots". These bond spots are concentrated areas of grit and the bonding material, where porosity is reduced or absent. Bond spots behave like a larger grit in a fine grit stone because they break down much differently. Ultimately, these bond spots may produce scratches on the surface to be microfinished or polished.

Another problem encountered is that there may be variations in bond chemistry from point to point within an abrasive stone which reduce the homogeneity of the abrasive stone. The differences in bond chemistry alter the strength of the bond, thereby influencing the nonuniformity of the breakdown.

Another problem encountered is a variation in product from lot to lot. It has been observed that abrasive stones will often vary more in hardness and other measured properties from stone to stone than from point to point within a stone. This difference in hardness makes it difficult for the user to adjust the microfinishing machinery. The variation is often a result of the inability of the manufacturer to make greenware of consistent density and the manufacturer's use of impure raw materials that differ from lot to lot.

One way of preparing abrasive articles is disclosed in U.S. Pat. No. 2,942,991, which describes a slip casting process using colloidal silica for making refractories. U.S. Pat. No. 2,768,087 discloses silicon carbide abrasives that also use colloidal silica as a bonding agent. That patent describes mixing silicon carbide with a silica sol, fused alumina and ceramic raw materials capable of reacting with the silica of the silica sol to form a strong ceramic matrix. This matrix can then be sintered to form a bond. Among these raw materials are mixtures of clays of high pyrometric cone equivalent with an alkali metal silicate. Firing temperatures needed for this sintering are in the area of about 1450° C.

Superfine grit abrasive articles can be prepared by a method known as "puddling." In this method a mixture of grit, fritted glass powder, clay and other raw materials, along with a green binder such as dextrin, is made into a slurry and put into a wooden form. This form is then placed into an oven and dried. The emerging block is shaved and fired. In the puddling process a density gradient can exist in the blocks due to the settling of coarser materials, and because raw materials that come from natural sources are used, the final product may also differ in composition. The result is varying bond strength which results in varying degrees of breakdown. In some cases the bond powders used in the puddling process are as large as or larger than the grit powders. Therefore, it is not unusual to observe concentrated areas of grit and bond, i.e., bond spots.

The uniformity of the final composition is also affected by its porosity. It is desired to have pores of uniform size and concentration throughout the article. It is difficult to control the porosity using methods such as puddling. Additives, such as coke, sawdust, walnut shell flour, and the like can be used to enhance this porosity, but may make the process more involved and ultimately affect the uniformity and performance of the abrasive article.

Another way of making abrasive articles is to cold-press a powder comprising a damp mixture of the grit, glass frit, clay and other raw materials along with a green binder such as dextrin. These mixes are made by blending the dry components with a small amount of water using a planetary mixer. The advantage of this procedure is that density can be controlled during the pressing operation, unlike in the puddling processes. However, it is difficult to achieve a completely homogeneous mixture and bond spots may result.

The above methods successfully produce abrasive articles, but do not solve problems resulting from nonhomogeneity throughout the matrix or variation in product with each shipment. Thus, what is needed in the art is a method of producing abrasive articles, particularly superfine abrasive articles, and the abrasive articles themselves, that are of uniform, homogeneous composition, both within the abrasive stones and from lot to lot.

SUMMARY OF THE INVENTION

Accordingly, the present invention provides a method of preparing an abrasive greenware article comprising admixing abrasive grits and a bond phase comprising silica particles, alumina, a flux and water, to form a slurry, such that the silica particles are on the average smaller than the average grit particles; drying the slurry to form a precursor powder; and compacting the precursor powder to form an abrasive greenware article. This greenware article can then be densified to form a densified abrasive article. In another embodiment, the present invention is the abrasive greenware article and densified abrasive article that are produced thereby.

DESCRIPTION OF THE PREFERRED EMBODIMENTS

The present invention is a method of preparing abrasive articles, and particularly superfine abrasive articles, which maintain homogeneous properties throughout the matrix and are less sensitive to variation in product from lot to lot than many currently known commercial processes. For the purpose of this application the word "superfine" shall be defined as referring to articles utilizing abrasive grits smaller than about 600 grit size (about 600 mesh or about 8 microns in diameter). The improved homogeneity is attributable to a novel bond chemistry and process as described below.

In general abrasive articles are prepared from grit materials and bond materials. Conventional grit materials such as silicon carbide, and aluminum oxide are preferred. Grit materials such as tungsten carbide, boron carbide, diamond, and others can also be used.

A significant aspect of the present invention is the use of a bond phase material comprising silica particles that are on the average smaller than the average grit particles. It is preferred that there be at least an order of magnitude difference in size, and it is more preferred that there be at least two orders of magnitude difference. This size rationing ensures that each grit particle is exposed to a portion of the silica particles with minimal mixing. It is preferred that the silica particles be very small, i.e., of colloidal size, with particles in the range of from about 0.003 micron to about 0.1 micron more preferred, and particles from about 0.01 micron to about 0.1 micron most preferred. In relation to this the grit particles average from about 60 mesh, or about 400 microns, to about 1500 mesh, or about 1.5 microns. It is preferred to use fine abrasive grits and fine silica particles; however, if it is desired to produce coarse grit abrasive articles, it is still preferred that the finer silica particles be employed. It is in either case required that the size differential be maintained. Various glass-formers can be substituted for part of the silica particles. These glass-formers include materials such as germanium oxide, boric oxide and phosphorus pentoxide. In this case the selected glass-former is preferably of a particle size comparable with that of the silica particles.

Also present in the bond phase is a quantity of alumina. The alumina is preferably in very fine particles in the same size ranges as the silica particles, e.g., colloidal alumina. Again, larger alumina particles can be used for producing coarse grit abrasives, but the finer alumina particles are more preferred for this purpose.

The bond phase is further modified by the addition of a flux. The flux is added to reduce the liquidus temperature and to enhance sintering when combined with the alumina and silica bond phase particles. It is preferred that the flux be such that full bond maturation can occur when the bond phase is densified at a temperature below about 1200° C., as described below. The flux is preferably an alkali metal oxide, such as potassium oxide or sodium oxide, but other metal oxides, such as, for example, magnesium oxide, calcium oxide, iron oxide, etc., can also be used. Of these potassium oxide is more preferred. In this case potassium oxide is preferably added in the form of a potassium silicate solution. Similarly, sodium silicate solution can be used to supply sodium oxide. Carbonates, such as potassium carbonate and sodium carbonate, which can be calcined to their oxide form, can also be used.

Finally, the bond phase is preferably still further modified with the addition of a temporary green binder such as a polyethylene glycol, a methylcellulose, a dextrin, a paraffin, a wax, poly(ethyloxazoline), or the like, or a mixture thereof. Of these poly(ethyloxazoline) is preferred. The binder can also be plasticized using various additives. For this a polyethylene glycol, tripropylene glycol, water, and mixtures thereof are preferred. These constituents are added to form the abrasive greenware article, but decompose when the greenware is densified, e.g., by sintering, and thus do not form a part of the final bond. Thus, for the purposes of this application "bond phase" is used to signify the non-grit components prior to densification, and "bond" is used to signify the non-grit components following densification.

In general a wide range of proportions of the above components can be employed. For example, it is preferred that the bond represent from about 5 percent to about 40 percent by weight on a dry basis of the total densified, e.g., sintered, composition (grit and bond). A range of from about 10 to about 30 percent by weight of the total densified composition is more preferred. It is also preferred that the silica content be from about 65 percent to about 90 percent by weight of the densified bond; that the alumina be from about 10 percent to about 30 percent by weight of the densified bond; and that the flux be from about 1 percent to about 5 percent by weight of the densified bond. Finally, it is preferred that the temporary green binder be from about 1 percent to about 10 percent by weight of the total densified composition, and that the plasticizer be from about 10 percent to about 20 percent by weight of the temporary green binder.

All of the components of the abrasive greenware article—grits and bond phase materials—are preferably combined as an aqueous slurry. Variations in the order of mixing are possible. For example, the alumina and silica particles and water can be mixed together first, then the flux added to this mixture. After this the optional binder and plasticizer can be added, and finally the grit is incorporated. Once all the components are combined the resultant slurry preferably comprises from about 40 to about 65 percent solids. High shear mixing after the addition of each component is preferred to ensure homogeneity.

Once the slurry of grit and bond phase materials is prepared it must be dried to form a precursor powder in order to allow compaction and densification. The preferred method of drying is spray drying, which results in the grit particles and the bond phase particles being clustered into a spherical mass that contains pores. The porosity is thus controlled, both in the spray dried particles and in the pressed green body, with the result that the bond phase and porosity are substantially uniform throughout the article.

The precursor powder can then be compacted to form an abrasive greenware article. For this cold pressing is preferred. Alternatively, hot pressing, isostatic pressing, hot isostatic pressing, or other conventional compaction means and techniques can be employed. It is preferred that the pressing be done at less than 5 tons per square inch, and that the density of the compacted body be from about 45 to about 75 percent of theoretical.

Because of the relatively smaller particles used in the bond phase it is possible to densify the abrasive greenware article at a temperature below the melting temperature. Thus, the densification of the greenware article can be accomplished by means of sintering. Firing at higher temperatures can also be done. An advantage of the present invention is that the densified abrasive article exhibits a porcelain bond composition having a high silica content. Thus, the bond phase of the present invention is effective for bonding abrasive grits such as silicon carbide, which tends to decompose during firing when using other bond materials having a lower silica and often high flux content. This contrasts with most porcelain bond compositions, such as those using mixtures of flint, feldspar, clays, and silicon carbide grit particles, which require firing at a temperature high enough to allow partial melting, but not enough to cause deformation, i.e., in the range of from about 1400° C. to about 1550° C. In contrast, the present invention's densified composition can be produced by firing at preferably from about 1000° C. to about 1200° C. This represents substantial energy and time savings.

Another advantage is that, because of the homogeneity attainable in the bond, a finer grit stone can be produced. Currently, a 600 grit stone approaches the finest produced, and is often of questionable quality. With the present invention it is possible to produce superfine abrasive greenware as well as densified, e.g., sintered, articles. For example, abrasive articles substantially finer than a 600 grit stone (600 mesh or about 8 microns diameter grit) can be produced. These superfine abrasive articles are suitable for use in hand-held or machine polishing of items such as crankshafts, cam shafts, bearing races, and other items demanding finishes that are high, i.e., less than about 5 microinches, and of uniform hardness, breakdown and grit size.

In order to better illustrate the present invention the following example is supplied. This example is intended to be illustrative only and not limitative of the scope of the invention.

EXAMPLE

About 10.2 kg of colloidal alumina (pH about 4, 20 percent solids) are placed in a mixing tank. About 40 kg of water are added and mixed to dilute the sol, and about 16.0 kg of colloidal silica (pH about 10, 50 percent solids) is added and mixed with the alumina. At the same time about 1.27 kg water is added to about 2.53 kg of a potassium silicate solution (12.7 percent $K_2O$, 26.5 percent $SiO_2$). This solution is then added to the sol and mixing is continued using a high speed, high shear mixer for 15 minutes.

A green binder/plasticizer solution is prepared by adding about 410 g of tripropylene glycol to about 9.13 kg of a 30 weight percent poly(ethyloxazoline) solution. This binder/plasticizer solution is added to the silica/alumina sol prepared above and the admixture is mixed for another 10 minutes.

When the above bond phase components have been prepared, the abrasive grit is incorporated. About 99 kg of 1000 mesh silicon carbide is slowly added to the admixture to form a slurry. The slurry is mixed for about 1 hour. The viscosity is adjusted to a level of about 500 centipoise in order to allow spray drying, by adding about 15 kg of additional water.

The slurry is pumped into a spray drier using an inlet temperature of about 400° C. and an exit temperature of about 145° C. The result is a bond/grit powder having an average particle size of about 300 microns.

The dry powder is screened through a 60 mesh (about 400 microns) screen to remove any debris and is then pressed using a uniaxial cold pressing technique. Pressing is done at almost 2 tons per square inch pressure.

The pressed parts are sintered in air with an electric kiln operating at a peak temperature of about 1150° C. The firing schedule is given in Table 1.

TABLE 1

| Temp (°C.) | Time (hr) | Process Stage |
|---|---|---|
| 100 | 1 | to dry |
| 100–482 | 5 | low temperature burnoff |
| 482 | 2 | hold to ensure complete burnoff |
| 482–1150 | 4 | ramp to peak temperature |
| 1150 | 4 | peak temperature |

The final pressed articles are superfine abrasive articles exhibiting uniform breakdown, porosity and bond strength.

What is claimed is:

1. A method of preparing an abrasive greenware article comprising:

(a) admixing abrasive grits and a bond phase comprising silica particles, callodial alumina, a flux selected from the group consisting essentially of metal oxides or precursors thereof and water, to form a slurry, such that the silica particles are on the average smaller than the average grit particles;

(b) drying the slurry to form a precursor powder;

(c) compacting the precursor powder to form an abrasive greenware article.

2. The method of claim 1 wherein the abrasive grits are selected from the group consisting of silicon carbide, alumina, tungsten carbide, boron carbide, diamond and mixtures thereof.

3. The method of claim 2 wherein the grits are on the average from about 1.5 microns to about 400 microns in diameter.

4. The method of claim 1 wherein the silica particles are colloidal silica.

5. The method of claim 4 wherein the silica particles are on the average from about 0.003 micron to about 0.1 micron in diameter.

6. The method of claim 1 wherein the flux is selected from the group consisting of potassium silicate, sodium silicate, potassium carbonate, sodium carbonate, potassium oxide, sodium oxide, magnesium oxide, calcium oxide, iron oxide and mixtures thereof.

7. The method of claim 1 wherein the alumina is colloidal alumina.

8. The method of claim 1 wherein a green binder is also present in the bond phase.

9. The method of claim 8 wherein the green binder is selected from the group consisting of a polyethylene glycol, a methylcellulose, poly(ethyloxazoline), a dextrin, a paraffin, a wax and mixtures thereof.

10. The method of claim 8 wherein the green binder is present in an amount from about 1 to about 10 percent by weight of the precursor powder.

11. The method of claim 8 wherein a plasticizer is also present in the bond phase.

12. The method of claim 11 wherein the plasticizer is selected from the group consisting of a polyethylene glycol, tripropylene glycol, water, and mixtures thereof.

13. The method of claim 11 wherein the plasticizer is present in an amount from about 10 to about 20 percent by weight of the bond phase.

14. The method of claim 1 wherein the slurry is from about 40 to about 65 weight percent solids.

15. The method of claim 1 wherein the silica comprises from about 65 to about 90 percent of the bond phase; the alumina comprises from about 10 to about 30 percent by weight of the bond phase; and the flux comprises from about 1 to about 5 percent by weight of the bond phase.

16. The method of claim 1 wherein the slurry is spray-dried.

17. The method of claim 1 wherein the compaction is accomplished by cold pressing, isostatic pressing hot pressing, or hot isostatic pressing.

18. The method of claim 1 wherein the abrasive greenware article is densified.

19. The method of claim 18 wherein the densification is accomplished by sintering.

20. The method of claim 19 wherein the sintering is done at a temperature from about 1000° C. to about 1200° C.

21. The method of claim 1 wherein the the bond phase, upon densification, forms a bond which is from about 5 to about 40 percent by weight of the abrasive article.

* * * * *